US006042040A

United States Patent [19]

Kurita et al.

[11] Patent Number: 6,042,040

[45] Date of Patent: Mar. 28, 2000

[54] TENSION ADJUSTING MECHANISM FOR CORD OR THE LIKE

[75] Inventors: Yasushi Kurita, Kyoto; Tomohiro Agaya, Nara-ken, both of Japan

[73] Assignee: Nitta Corporation, Japan

[21] Appl. No.: 09/117,126

[22] PCT Filed: Jan. 13, 1997

[86] PCT No.: PCT/JP97/00046

§ 371 Date: Jul. 22, 1998

§ 102(e) Date: Jul. 22, 1998

[87] PCT Pub. No.: WO97/27137

PCT Pub. Date: Jul. 31, 1997

[30] Foreign Application Priority Data

Jan. 23, 1996 [JP] Japan ..... 8-009047
Dec. 26, 1996 [JP] Japan ..... 8-348387

[51] Int. Cl.[7] ..... B65H 51/32

[52] U.S. Cl. ..... 242/365.7; 242/366.1; 242/364.2; 242/418.1

[58] Field of Search ..... 242/365.7, 366, 242/366.1, 364.2, 364.3, 418.1; 226/44, 108

[56] References Cited

U.S. PATENT DOCUMENTS

| | | | |
|---|---|---|---|
| 2,266,467 | 12/1941 | Lovett | 242/366 X |
| 2,266,557 | 12/1941 | Kline | 242/366 X |
| 2,350,182 | 5/1944 | Neff | 242/366 X |
| 3,938,751 | 2/1976 | Kawakami et al. | 242/365.7 |
| 4,574,597 | 3/1986 | Buck et al. | 242/366 X |
| 4,669,677 | 6/1987 | Roser et al. | 242/366.1 |
| 4,890,800 | 1/1990 | Lenk et al. | 242/366 |
| 5,035,372 | 7/1991 | Siebertz . | |
| 5,421,534 | 6/1995 | Arnold et al. | 226/44 X |
| 5,454,151 | 10/1995 | Bogucki-Land et al. | 242/418.1 X |

FOREIGN PATENT DOCUMENTS

| | | | |
|---|---|---|---|
| 380913 | 8/1990 | European Pat. Off. . | |
| 46-20044 | 7/1971 | Japan . | |
| 59-172362 | 9/1984 | Japan | 242/364.2 |
| 61-55096 | 3/1986 | Japan . | |
| 61-170708 | 8/1986 | Japan . | |
| 229094 | 8/1990 | Japan . | |
| 2239065 | 9/1990 | Japan . | |
| 3232667 | 10/1991 | Japan . | |
| 428671 | 1/1992 | Japan . | |
| 616336 | 1/1994 | Japan . | |
| 6101132 | 4/1994 | Japan . | |
| 6219647 | 8/1994 | Japan . | |
| 6255883 | 9/1994 | Japan . | |

*Primary Examiner*—Donald P. Walsh
*Assistant Examiner*—Minh-Chau Pham
*Attorney, Agent, or Firm*—Morrison Law Firm

[57] ABSTRACT

A tension adjusting mechanism for cord or the like can adjust tension more appropriately than conventional ones. The tension adjusting mechanism comprises a wrapping roller (2), for the cord or the like, which is formed such that it can be rotatingly driven by a drive means, detects tension on the cord or the like (C) after leaving the wrapping roller (2), and controls the drive means so as to make the detected tension approach a proper value suitable for the cord or the like (C).

8 Claims, 6 Drawing Sheets

TENSION ADJUSTING MECHANISM FOR CORD OR THE LIKE

FIELD OF THE INVENTION

The present invention relates to a tension adjusting mechanism for cord or the like (for example, string) to be put on a fiber machine or the like.

BACKGROUND OF THE INVENTION

Hitherto a system of adjusting frictional force between a cord and a frictional roller with a weight is known as a tension adjusting mechanism for cord or the like (such as string) to be put on a fiber machine or the like. Proper tension is given to string depending on its kind from the condition in which tension is hardly loaded on the string being pulled out of a delivery bobbin. The proper value of tension given to the string is related, for instance, to the denier number of the string itself, and is normally as extremely small as several gf through several tens gf.

Since the adjustment of tension in the conventional system is conducted sensuously by the position and the like of the weight, the adjustment to a proper value is not usually obtained. Namely, improper tension setting causes the string to be worn out by friction and thereby gives a bad influence on the quality.

It is therefore an object of the present invention to provide a tension adjusting mechanism for cord or the like which can adjust tension more appropriately than conventional ones.

SUMMARY OF THE INVENTION

The tension controlling mechanism of cord according to the present invention includes a wrapping roller for cord or the like, which is formed such that it can be rotatingly driven by a drive means, detects tension on the cord after leaving the wrapping roller, and controls the drive means so as to make the detected tension approach a proper value suitable for the cord. And the mechanism employs a motor as the driving means, uses mechanical loss of the motor as load when the wrapping roller rotates, and control the motor in output within a range of loss load.

Since the mechanism is designed to detect tension on the cord after leaving the wrapping roller and control the driving means so as to make the detected tension approach a proper value suitable for the cord, controlling the driving means allows tension to be adjusted to a proper value.

Furthermore, since the mechanism employs a motor as the driving means, uses mechanical loss of the motor as load when the wrapping roller rotates, and controls the motor in output within a range of loss load, load can be applied to the roller efficiently in power saving.

By controlling the driving means, a peripheral speed of the wrapping roller can be controlled. With such constitution, tension on the cord can be adjusted by a simple means of controlling a peripheral speed of the wrapping roller.

The tension controlling mechanism may include a wrapping roller on the input side of the cord and another wrapping roller on the output side thereof, and be constituted such that tension is produced on the cord between the rollers, and be formed such that at least the wrapping roller on the output side can be rotatingly driven by the driving means. In such constitution, even when there are some tension fluctuations on the cord being pulled out from the delivering bobbin, the influence of such original tension fluctuations on the cord after leaving may be relieved by the tension on the cord produced between the input side and output side wrapping rollers.

The tension controlling mechanism may be constituted such that the peripheral speed difference between the input side and output side wrapping rollers can cause to produce tension on the cord between the wrapping rollers. In such constitution, tension can be produced with an easy means on the cord between the input side and output side wrapping rollers.

The tension controlling mechanism may also be constituted such that the peripheral speed difference between the input side and output side wrapping rollers can cause the cord to be extended therebetween. In this construction, the cords can be extended simultaneously.

The wrapping roller on the input side and the wrapping roller on the output side may be formed to be rotated coaxially and integrally, and the diameter of the output side wrapping roller may be set larger than that of the input side wrapping roller. With this construction, the peripheral speed difference between the input side and output side wrapping rollers can be obtained by easy means.

The tension controlling mechanism may include three or more wrapping rollers in total including the input side and output side wrapping rollers. Such multiple stage constitution provides the following advantages.

1. If there is a big difference in outer diameter between rollers, tension fluctuations might be enlarged depending on the cord (string) to be used. In such a case, it is advisable to extend the cord gradually. It is preferable to use a multiple stage system roller, for example, when a higher tension is required on cord of low elasticity.

2. Gradual enlargement of slide by cord extension reduces the influence of abrasion of the cord, and simultaneously provides a large frictional force. With such a large frictional force, the setting range of tension can be widened, and the motor using capacity at a high tension force setting can be made smaller, so that the controlling operation can be done with a smaller motor.

3. In case of string of high elasticity, the extension fluctuations are extremely small up to a certain extension percentage, but over such a percentage it becomes stronger abruptly. When controlling tension on such string, the large extension at the first stage does not contribute change in tension. It is preferable to set to a correct tension at the second stage or later.

A tension sensor may be provided on a wrapping roller provided behind the output side wrapping roller. With such constitution, tension on the cord after being output can be easily detected.

PREFERRED EMBODIMENT OF THE INVENTION

Preferred embodiments of the present invention are described below in conjunction with the accompanying drawings.

EMBODIMENT 1

Figure 1:
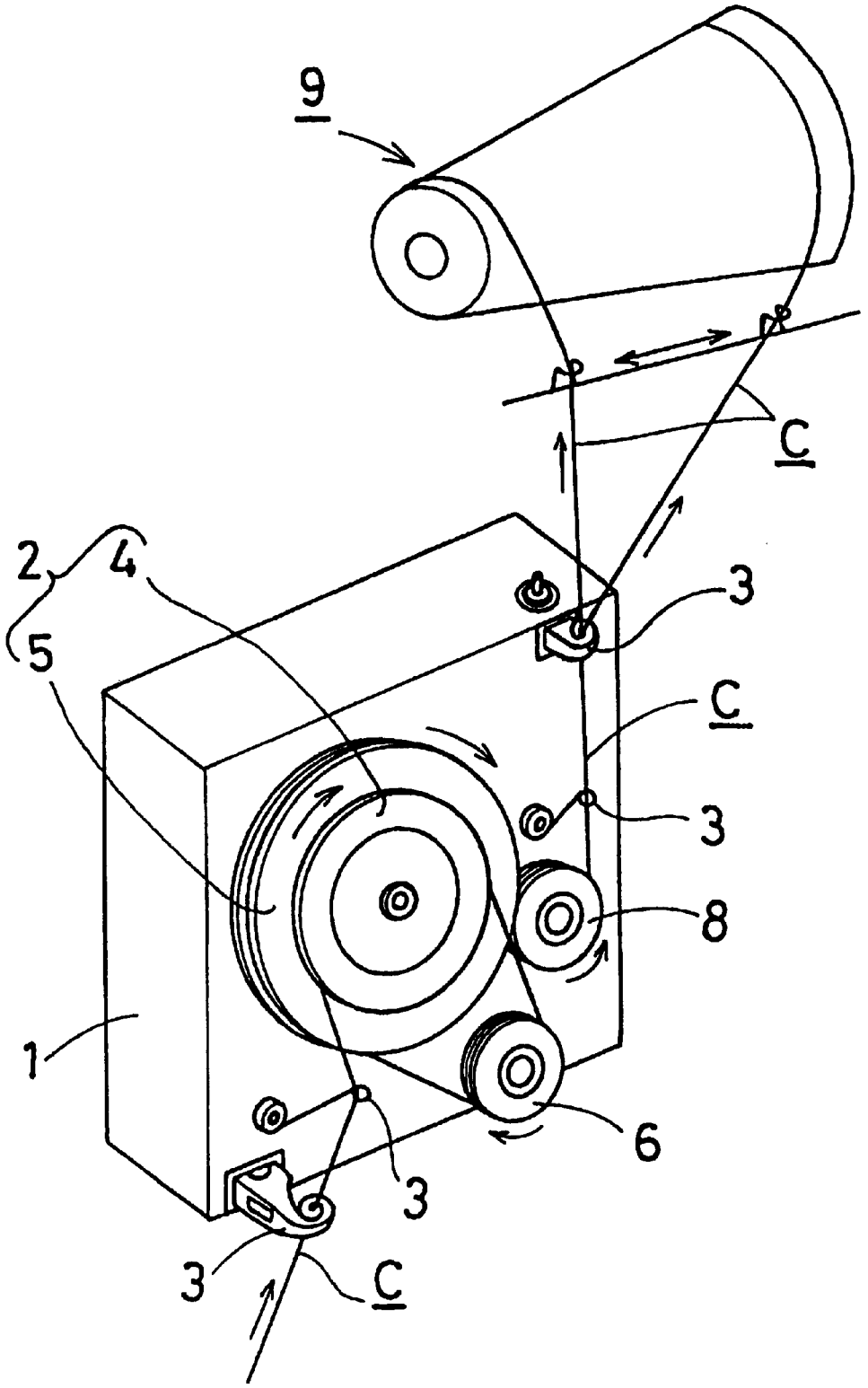
FIG. 1 is a perspective view illustrating Embodiment 1 of a cord tension controlling mechanism of the present invention.

As illustrated in FIG. 1, the cord tension controlling mechanism of this embodiment has a cord wrapping roller 2 formed to be rotatingly driven by a driving means (which is located within a housing 1, but not shown). In this embodiment, a motor (shown as M in FIGS. 3 and 4) is used as a driving means. Numerals 3's respectively denote string guides.

The cord wrapping roller 2 includes a wrapping roller 4 on the input side of cord and a wrapping roller 5 on the output side thereof. Tension is produced on cord C between both the rollers as described later.

The input side wrapping roller 4 and the output side wrapping roller 5 are formed so as to be rotated coaxially and integrally. The diameter of the output side roller is set larger than that of the input side roller. In this embodiment, the outer peripheral face of the roller is processed in V slot so as to have two staged diameters.

With such constitution, the outer peripheral speed of the input side wrapping roller 4 which has a smaller diameter becomes slower, while the outer peripheral speed of the output side wrapping roller 5 which has a larger diameter becomes faster. And the peripheral speed difference between the input side wrapping roller 4 and the output side wrapping roller 5 can be obtained by simple means. Numeral 6 denotes a guide roller for transferring the winding from the input side wrapping roller 4 to the output side wrapping roller 5.

The peripheral speed difference between the input side wrapping roller 4 and the output side wrapping roller 5 causes tension on the cord C between both the rollers, so that tension can be obtained on the cord C between the input side and output side wrapping rollers 4, 5 by simple means. Namely, the input side and output side wrapping rollers 4, 5 which are coaxial and integral function as rollers for giving tension to the cord C.

The peripheral speed difference between the input side wrapping roller 4 and the output side wrapping roller 5 lengthens the cord C therebetween, and the cord C is transferred in winding and simultaneously extended.

The string tension from a cord delivering bobbin (see 7 in FIG. 2) is normally nearly zero because the cord is freely unwound, and the tension near the input side of the input side wrapping roller 4 is almost zero. However, the peripheral speed difference between the input side wrapping roller 4 and the output side wrapping roller 5 allows to set tension therebetween suitable for the string diameter and the like.

Namely, it it possible to optimize the string extending distortion due to the peripheral speed difference between the input side and output side wrapping rollers 4 and 5. In this embodiment, the peripheral speed difference is set by the proportion or ratio in diameter of the input side wrapping roller 4 and the output side wrapping roller 5.

The wrapping roller 2 which is coaxial and integral is rotatingly driven by the driving means and even when some tension fluctuations (for example, catching of the string pulled out from the delivering bobbin causes unexpected load) occur on the cord C pulled out from the delivering bobbin, the tension on the cord C produced between the input side cord wrapping roller 4 and the output side cord wrapping roller 5 can reduce the influence of the original tension fluctuations on the cord after being output.

A turnabout wrapping roller 8 provided behind the output side roller includes a string tension sensor (not shown). The roller with the tension sensor detects tension on the cord C after being output. In this embodiment, a capacitance type sensor for super low loading is used as the tension sensor.

When the motor is not working, a motor shaft is forced to be rotated by the frictional force between the cord and the roller. When the motor shaft is rotated by and with the cord, magnetic loss between a rotor and a yoke of the motor becomes mechanical loss. The mechanical loss is used as load (torque) when the roller rotates, and the motor is controlled in output within the range of loss load, so that load can be applied to the roller efficiently in power saving.

When energy corresponding to the magnetic loss is fed so as to let the motor rotate by itself, tension on the cord becomes the frictional force produced between the wrapping rollers. When energy corresponding to the frictional force is fed to the motor, the tension of the cord becomes zero, and from this point the tension setting control at an extremely low value can be conducted.

The development of motor has been in general aiming at reducing mechanical loss due to magnetism as much as possible, and showing a tendency to use more expensive magnetic material. However, in the tension adjusting mechanism of this embodiment, mechanical loss of the motor is reversely employed, and in a high tension setting, it is possible to use a relatively low-priced motor having large loss.

With a motor having a bush, the energy self generated by the motor may be used and fed to be re-used, so that it is possible to control tension on the cord in a wider tension range.

The using condition of the cord tension controlling mechanism in this embodiment is described below.

When the motor M of the tension adjusting mechanism is not working in case of transferring the winding of cord, a tension force of a take-up apparatus 9 after the cord is output and tension resisting thereto and applied on the string due to braking function of the motor M of the tension adjusting mechanism are maximum. In the relationship to the take-up speed of the take-up apparatus 9, the motor M is set to work such that tension applied on the string converges to a set value. The motor M is set to work such that the peripheral speed of the output side wrapping roller 5 is a little slower than the take-up speed of the take-up apparatus 9. And the number of revolution of the motor M is adjusted and controlled so that a sensing pressure of the tension sensor may become constant near a set value.

When the motor M is not working, the tension applied on the string is maximum and the tension fluctuations are large (it is conceivable that this is caused by unexpected load such as catching of the string pulled out from the delivering bobbin). However, tension on the cord C produced between the input side wrapping roller 4 of cord and the output side wrapping roller 5 thereof can reduce the influence of the original tension fluctuations upon the cord after being output, and adjustment and control of the revolution of the motor M with a set feedback by the tension sensor may reduce tension applied on the string and tension fluctuation. Transfer of the winding can be conducted with a substantially constant tension. This mechanism can also set refine cord tension suitable for cord of low tension.

The tension of the cord C after being output from the output side wrapping roller 5 is detected by the tension sensor, the motor M as a driving means is controlled so as to make the detected tension approach a proper value suitable for the cord C, and the peripheral speed of the output side wrapping roller 5 is controlled. Namely, it is advantageous that controlling the driving means can adjust tension to a proper value suitable for the cord C, and that controlling the peripheral speed of the output side wrapping roller 5 can simply adjust tension of the cord C.

Formerly in transferring the winding of cord C, unexpected load such as catching of string pulled from a delivering bobbin often causes an actual tension of the string to fluctuate, and the unexpected tension fluctuations result in friction and wear of the string and exert a bad influence on the quality. However, in this embodiment, influence of tension fluctuations before input upon the cord after output can be reduced, and the influence in quality of string due to friction and wear can be minimized. As a result, this mechanism can advantageously transfer the winding of the cord C with keeping its original high quality.

By providing a brake (not shown) on the output side wrapping roller 5, this mechanism can be made for controlling cord of high tension, and by using a rotary magnetic field of the motor M, it can be for controlling cord of medium tension.

EMBODIMENT 2

Embodiment 2 is now described focusing on the difference thereof from Embodiment 1.

Figure 2:
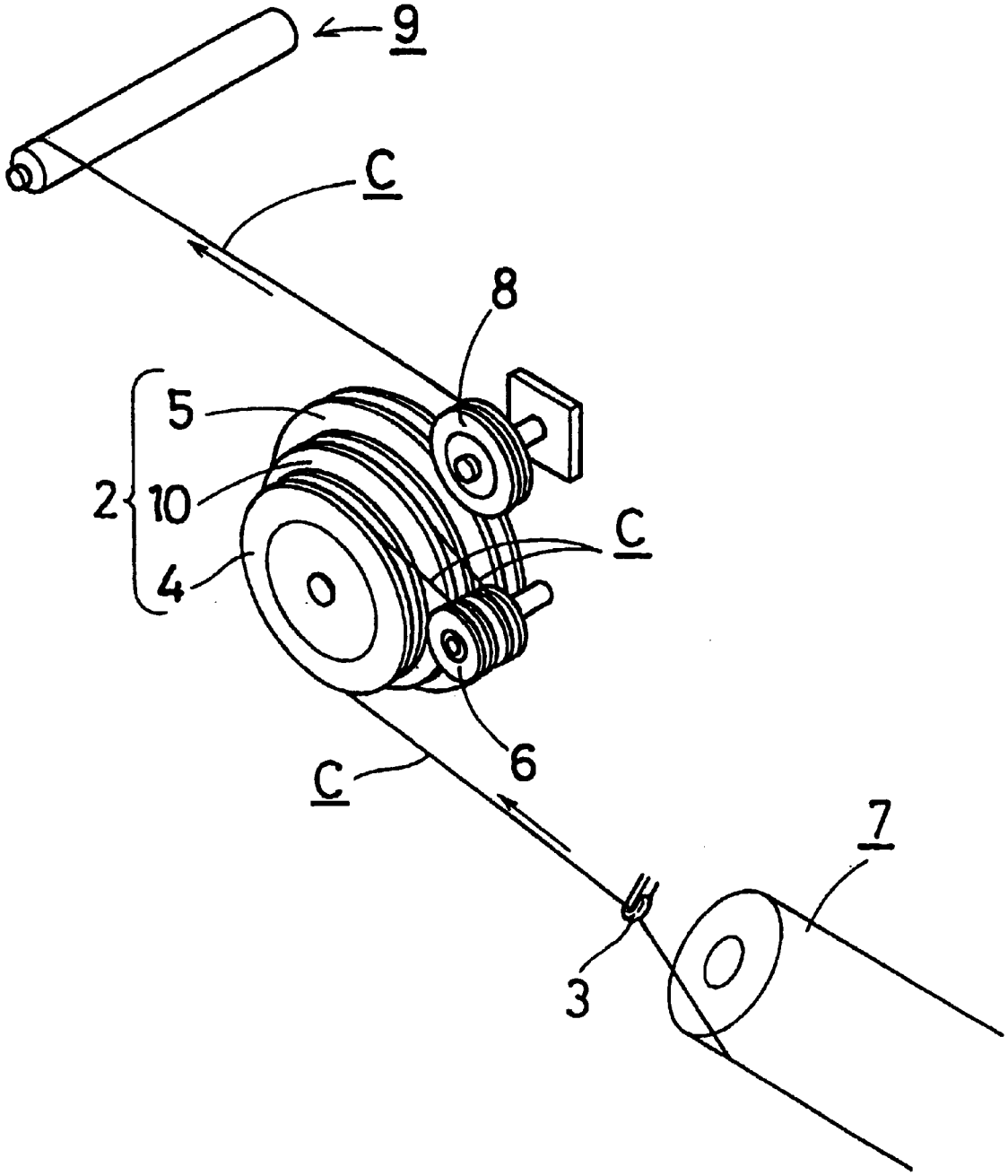
FIG. 2 is a perspective view showing Embodiment 2 of a cord tension controlling mechanism of the present invention.
Figure 3:
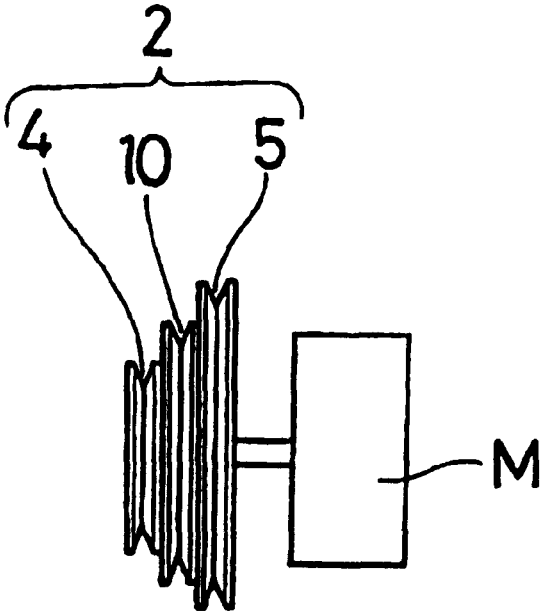
FIG. 3 is a side view illustrating a wrapping roller on the output side of the cord tension controlling mechanism of FIG. 2.
Figure 4:
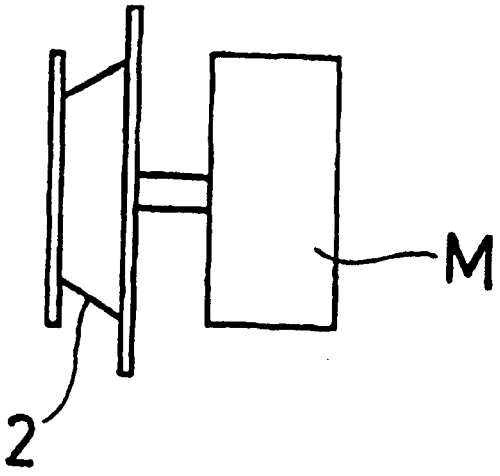
FIG. 4 is a side view for showing another wrapping roller on the output side different from the one in FIG. 3.

As shown in FIGS. 2 to 4, the cord tension controlling mechanism of this embodiment is provided with three roller diameters from the wrapping roller 4 on the input side to the wrapping roller 5 on the output side. Namely, a third wrapping roller 10 having a medium roller diameter is provided. The constitution of such a multi-stage system having three or more wrapping roller diameters, instead of two diameters, has the following advantage.

1. When there is a big difference in outer diameter between rollers, tension fluctuations might be enlarged depending on the cord (string) to be used. In such a case, it is advisable to extend the cord gradually. It is preferable to use a multiple stage system roller, for example, when a higher tension is required on cord of lower elasticity.

2. Gradual enlargement of slide by cord extension reduces the influence of abrasion of the cord, and simultaneously provides a large frictional force. With such a large frictional force, the setting range of tension can be widened, and the motor using capacity at a high tension force setting can be made smaller, so that the controlling operation can be done with a smaller motor.

3. In case of string of high elasticity, the extension fluctuations are extremely small up to a certain extension percentage, but over such a percentage it becomes stronger abruptly. When tension of such string is controlled, the large extension at the first stage does not contribute change in tension. It is preferable to set to a correct tension at the second stage or later.

FIG. 3 shows a wrapping roller 2 which has three or more diameters and formed as a V-slotted staged roller, while FIG. 4 shows a wrapping roller 2 which has three or more diameters and formed as a taper roller.

EMBODIMENT 3

Figure 5:
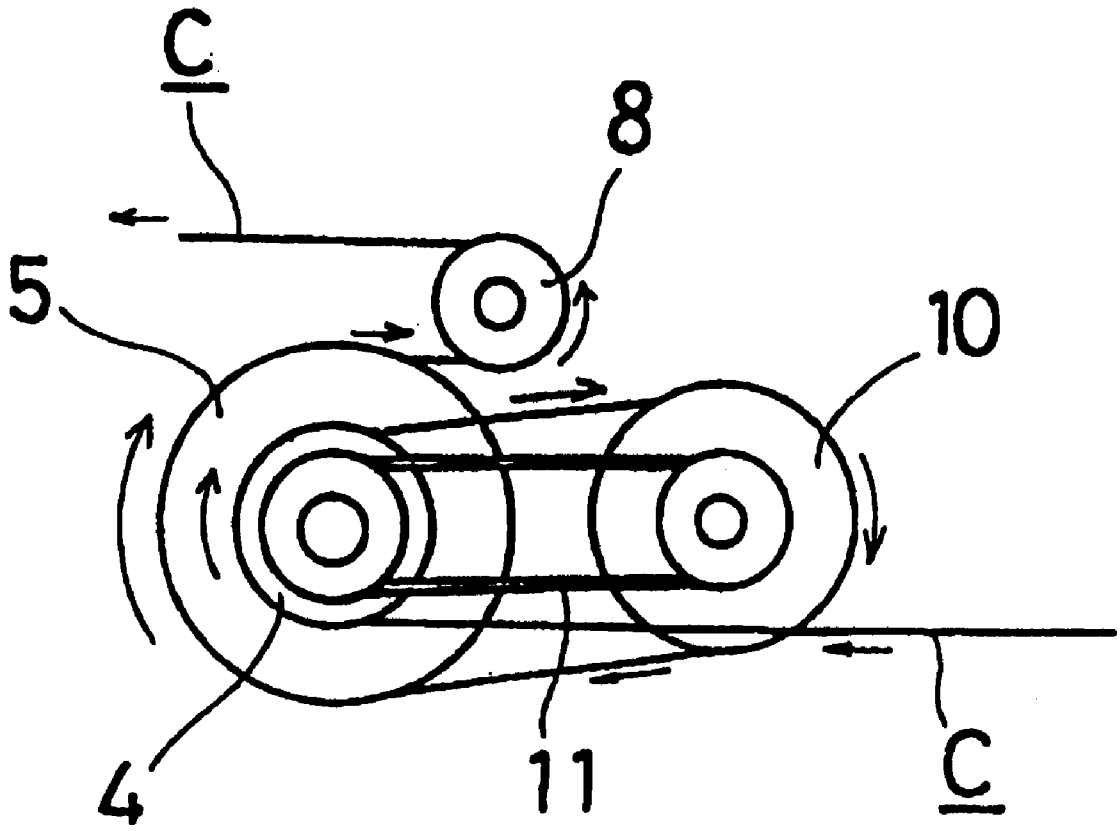
FIG. 5 is a front view showing Embodiment 3 of a cord tension controlling mechanism of the present invention.

As shown in FIG. 5, the cord tension controlling mechanism of this embodiment has a wrapping roller 4 on the cord input side and a separate wrapping roller 5 on the cord output side, and tension occurs on the cord C between these rollers. The output side wrapping roller 5 is formed so as to be rotatingly driven by the motor M as a driving means. Numeral 11 denotes a belt for rotating the wrapping rollers together. At least the output side wrapping roller 5 may be formed to be rotatingly driven.

Namely, the input side wrapping roller 4 and the output side wrapping roller 5 are not necessarily formed coaxially as in Embodiments 1 and 2 and can be constructed as separate bodies.

EMBODIMENT 4

The embodiment 4 is below described focusing on the difference thereof from the foregoing embodiments.

Figure 6:
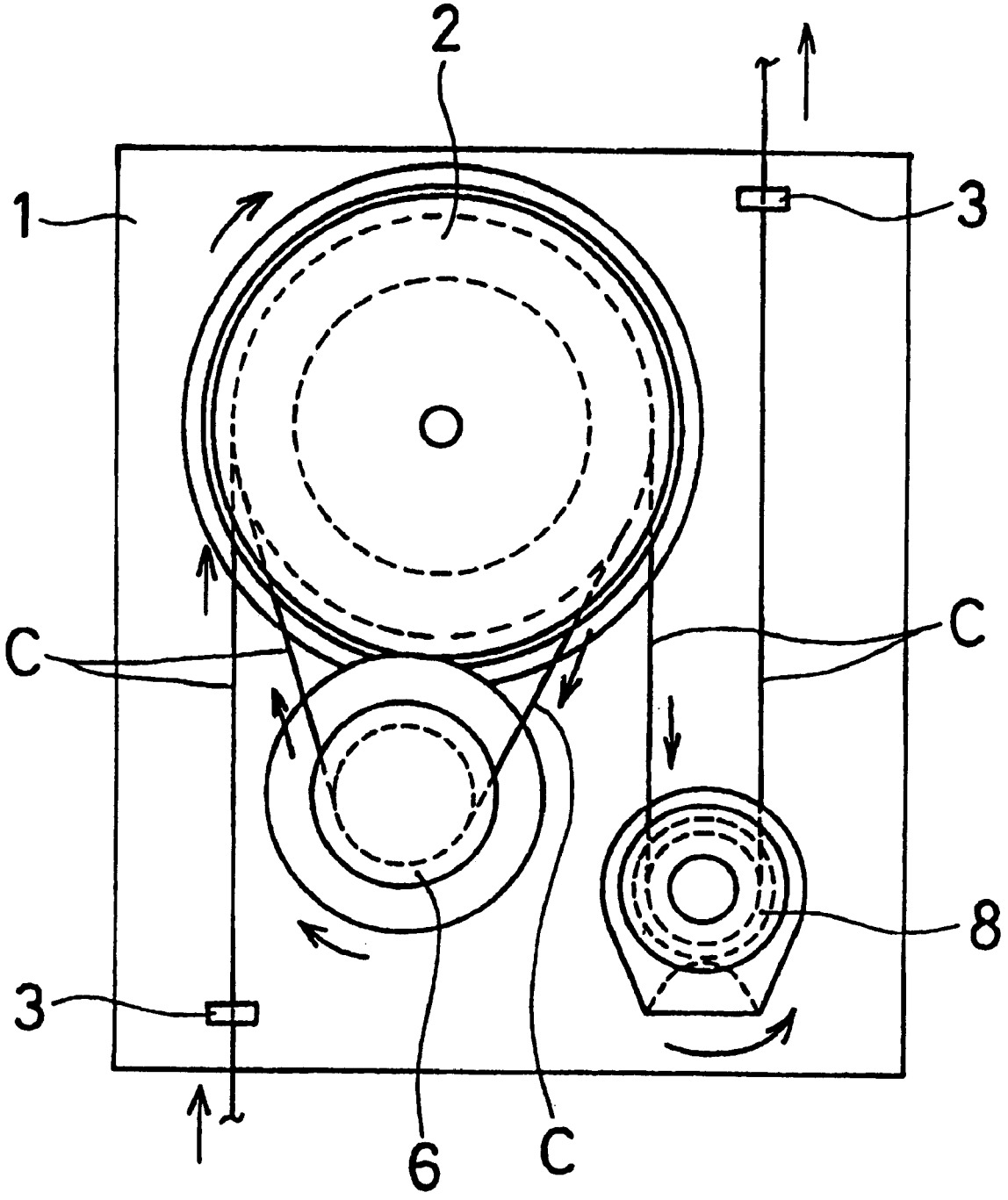
FIG. 6 is a front view showing Embodiment 4 of a cord tension controlling mechanism of the present invention.
Figure 7:
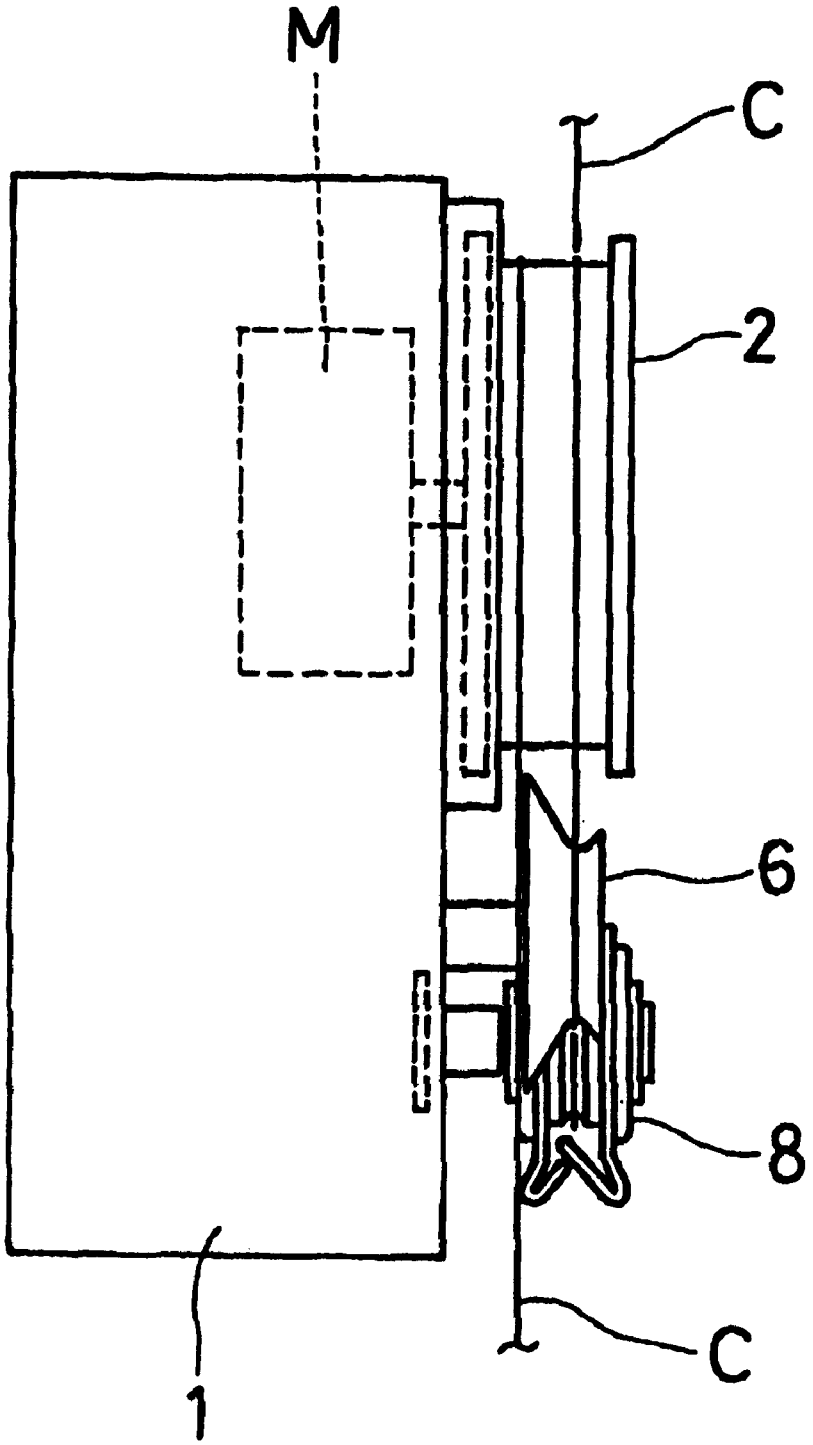
FIG. 7 is a side view showing the cord tension controlling mechanism of FIG. 6.

As shown in FIGS. 6 and 7, the cord tension controlling mechanism of this embodiment has a cord wrapping roller 2 (a tension pulley) formed to be rotatingly driven by the motor M as a driving means. The mechanism receives the cord on this wrapping roller 2, and then on a wind transfer guide roller (a return pulley), and again back on the wrapping roller 2. Tension on the cord C after leaving the wrapping roller 2 is detected by a tension sensor (a capacitance type sensor) provided on a turnaround wrapping roller 8 (a sensor pulley), so that the driving means may be controlled to make the detected tension approach a proper value suitable for the cord C. The string route through the mechanism is the same as FIG. 1.

The wrapping roller 2 used herein has one diameter, and receives the cord twice through the wind transfer guide roller 6. A known spring tenser (not shown) is provided on the input side so as to remove a chatter on string.

In order for the detected tension by the tension sensor to approach a proper value suitable for the cord C, the motor M as a driving means is controlled to control the the peripheral speed of the wrapping roller 2.

The cord tension adjusting mechanism has an extremely simple structure with the cord wrapping roller 2 having one diameter. Therefore the mechanism is very excellent in working and operation in the first stage of putting the string therethrough (the direction and order thereof are similar to those in FIG. 1). Employing the spring tenser together, the mechanism has the advantage of being preferably practical.

Constructed as stated above, the present invention has the following effect.

Since the driving means is controlled so that the detected tension may approach a proper value suitable for the cord, the present invention may provide the tension adjusting mechanism for the cord or the like which can adjust tension more appropriately than conventional ones.

We claim:

1. A tension adjusting mechanism for cord comprising a cord wrapping roller formed so as to be rotatingly driven by a driving means, detecting tension of cord after leaving said wrapping roller, and controlling the driving means so as to make the detected tension approach a proper value suitable for the cord, and wherein said mechanism employs a motor as said driving means, uses mechanical loss of said motor as load when said wrapping roller rotates and controls said motor in output within a range of load loss.

2. A tension adjusting mechanism according to claim 1, wherein a peripheral speed of said wrapping roller is controlled by controlling said driving means.

3. A tension adjusting mechanism according to claim 1, said mechanism further comprising an input side wrapping roller and an output side wrapping roller wherein tension is produced on said cord between said rollers and at least said output side wrapping roller is formed to be rotatingly driven by said driving means.

4. A tension adjusting mechanism according to claim 3, wherein tension is caused between said rollers by a difference in peripheral speed between said input side and output side wrapping rollers.

5. A tension adjusting mechanism according to claim 4, wherein a difference in peripheral speed between said input side and output side wrapping rollers causes the cord to be extended therebetween.

6. A tension adjusting mechanism according to claim 3, wherein said input side and output side wrapping rollers are coaxial and integrally rotated and a diameter of said output side wrapping roller is larger than that of said input side wrapping roller.

7. A tension adjusting mechanism according to claim 3, wherein said mechanism comprises three or more wrapping rollers including said input side and output side wrapping rollers.

8. A tension adjusting mechanism according to claim 1, further comprising a wrapping roller after the cord is output, said wrapping roller being provided with a tension sensor.

* * * * *